US005669560A

United States Patent [19]

Upton, III et al.

[11] Patent Number: 5,669,560

[45] Date of Patent: Sep. 23, 1997

[54] NON-PULPABLES COLLECTION CHAMBER WITH REMOVABLE BASKET FOR SOLID WASTE PULPERS

[75] Inventors: William K. Upton, III, Chester, Md.; William E. Schneider, White Pine, Tenn.; Stuart H. Brown, Severna Park, Md.; Steven A. Stetz, Stevensville, Md.; Emily J. Gotich, Crofton, Md.; Jack L. McCrea, Pittsburgh, Pa.

[73] Assignee: The United States of America as represented by the Secretary of the Navy, Washington, D.C.

[21] Appl. No.: 646,570

[22] Filed: May 8, 1996

Related U.S. Application Data

[62] Division of Ser. No. 312,948, Sep. 30, 1994, Pat. No. 5,551,641.

[51] Int. Cl.[6] ..... B02C 23/08

[52] U.S. Cl. ..... 241/69; 241/100

[58] Field of Search ..... 241/46.17, 69, 241/79, 82, 100; 220/500, 501

[56] References Cited

U.S. PATENT DOCUMENTS

| | | | |
|---|---|---|---|
| 3,188,942 | 6/1965 | Wandel | 241/46.17 X |
| 3,682,398 | 8/1972 | Lamort | 241/46.17 |
| 3,926,379 | 12/1975 | Dryden et al. | 241/69 |
| 4,030,671 | 6/1977 | Couture | 241/15 |
| 4,634,059 | 1/1987 | Bahr et al. | 241/79 X |
| 5,464,161 | 11/1995 | Upton, III et al. | 241/21 |
| 5,551,641 | 9/1996 | Upton, III et al. | 241/46.17 |

*Primary Examiner*—John M. Husar
*Attorney, Agent, or Firm*—Howard Kaiser

[57] ABSTRACT

A pulper includes a pulping chamber, a pulping mechanism, and a non-pulpables collection chamber attached to a bottom of the pulping chamber below a top of the pulping mechanism in an annular area outside of the pulping mechanism. The collection chamber includes a container with openings at first and second ends; a basket having an opening at a first end and disposed inside the container wherein at least a bottom portion of the basket includes perforations; a pipe connection located at the second end of the container; means for removing the basket from the container; and means for preventing material from entering a space between the basket and the container; wherein the first end of the container is inserted into the pulping chamber. The collection chamber does not interfere with the fluid flow around the pulping mechanism and can collect a relatively large amount of non-pulpables without requiring pulper shutdown.

13 Claims, 2 Drawing Sheets

NON-PULPABLES COLLECTION CHAMBER WITH REMOVABLE BASKET FOR SOLID WASTE PULPERS

This application is a division of application Ser. No. 08/312,948, filed 30 Sep. 1994, now U.S. Pat. No. 5,551,641, issued 03 Sep. 1996.

STATEMENT OF GOVERNMENT RIGHTS

The invention described herein may be manufactured and used by or for the Government of the United States of America for governmental purposes without the payment of any royalties thereon or therefor.

BACKGROUND OF THE INVENTION

The present invention relates in general to a non-pulpables collection chamber for a solid waste pulper and, in particular, to a non-pulpable collection chamber having a removable basket.

Solid waste pulpers process cellulose-based and food waste products into a pumpable slurry. Metal and other dense or hard materials, which may be introduced into the pulper, may damage the pulping mechanism. The pulping mechanism is generally a set of rotating blades passing near a set of stationary blades. The purposes of the non-pulpables collection chamber (or junkbox) are to collect the metal and other dense or hard objects so that they will not harm the pulping mechanism and to provide for easy removal of these materials.

Previous methods of non-pulpable or junk collection were based on a dam or restriction in the bottom of the pulping chamber in the annular area adjacent the pulping mechanism. This type of non-pulpables collection area disturbs the fluid flow within the cylindrical pulping chamber and severely limits the amount of non-pulpable material that can be held.

SUMMARY OF THE INVENTION

It is an object of the present invention to provide a non-pulpables collection chamber with a removable basket that does not interfere with the fluid flow around the pulping mechanism.

It is another object of the present invention to provide a non-pulpable collection chamber that can collect a relatively large amount of non-pulpables without requiring pulper shut down.

It is a further object of the present invention to provide a non-pulpable collection chamber that allows a clean water counterflow up through the chamber to keep pulp from settling in the basket.

It is yet another object of the present invention to provide a non-pulpable collection chamber wherein the basket can be quickly and easily removed through the pulping chamber after the pulper shutdown and cleaned by inverting it and tapping it against a hard surface wherein no tools are required for removal.

These and other objects of the invention are achieved by a collection chamber comprising a container having openings at first and second ends; a basket having an opening and disposed inside the container wherein at least a bottom portion of the basket includes perforations, the bottom portion being positioned proximate the second end of the container; a pipe connection located at the second end of the container for permitting fluid flow into said container and via said perforations into said basket; means for removing the basket from the container; and means for preventing material from entering a space between the basket and the container.

Preferably, a cross-section of the container from the second end to at least a location of the means for restricting is constant.

The cross-sections of the container and the basket may be rectangular.

In another aspect of the invention, a pulper comprises a pulping chamber having a pulping mechanism; and a collection chamber attached to a bottom of the pulping chamber below a top of the pulping mechanism in an annular area outside of the pulping mechanism.

Preferably, an angle between the pulping chamber and the collection chamber is about 15° to 30°.

These and other objects, features and advantages of the invention will become apparent from the following detailed description taken in conjunction with the accompanying drawing.

BRIEF DESCRIPTION OF THE DRAWINGS

The drawing is hereby expressly made a part of the specification.

DETAILED DESCRIPTION OF THE PREFERRED EMBODIMENTS

The non-pulpables collection chamber of the present invention has several advantages. First, it is located outside of the pulping chamber and, therefore, it does not interfere with the fluid flow around the pulping mechanism. This allows the hydrodynamic characteristics of the pulping chamber to be optimized. Second, the collection chamber allows a relatively large amount of non-pulpables to be collected without requiring pulper shutdown. That is, the size of the collection chamber is not limited by the interior dimensions of the pulping chamber, as in the prior art. Another advantage of the present invention is that it allows a clean water counterflow up through the collection chamber to keep pulp out of the basket. When the collection chamber has a constant cross-section, the velocity of water through the collection chamber is constant and greater than the settling velocity of pulp. Therefore, any pulp that may enter the collection chamber is eventually pushed back out of it. The inventive non-pulpable collection chamber includes a basket that can be quickly and easily removed through the pulping chamber after pulper shutdown. The basket can be cleaned by inverting it and tapping it against a hard surface. No tools are required to remove the basket from the pulping chamber.

Figure 1:
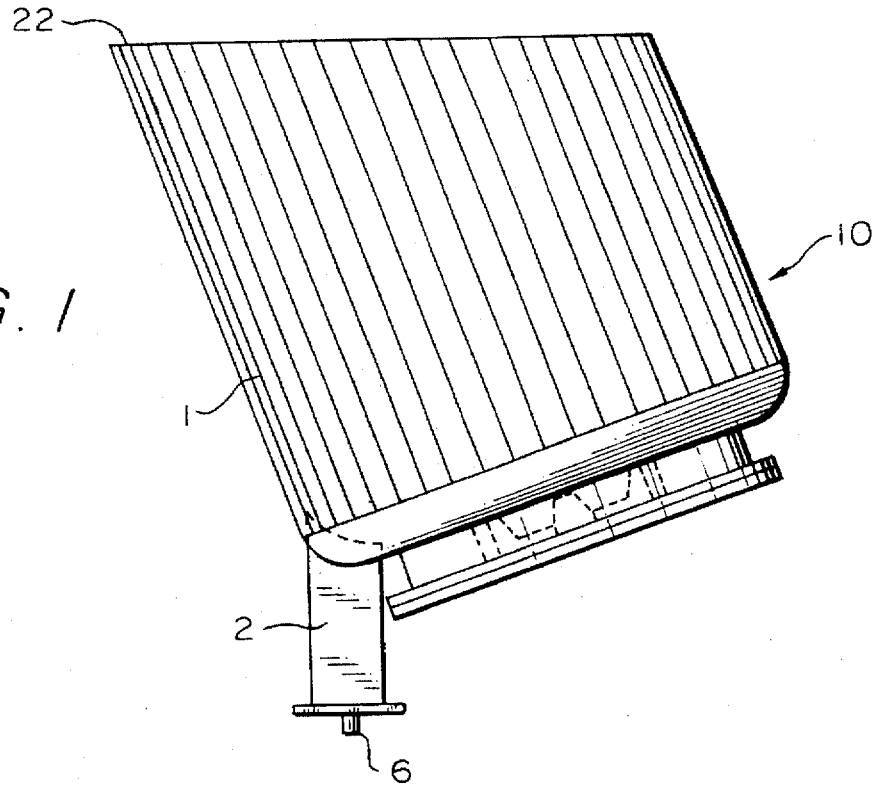
FIG. 1 is a schematic drawing of the invention.

The non-pulpables collection chamber was invented for use with a device called a pulper. The pulper 10 includes a pulping chamber 1 (FIGS. 1 and 2) having a cylindrical or elliptical shell with a flat or curved bottom and a top 22. Cellulose and organic products or waste enter the pulping chamber 1 through a feed chute (not shown) attached to the top 22 of the chamber 1. The material to be pulped is chopped and wetted into a pumpable slurry by using a rotating cutting, beating, or flailing mechanism 5 into which water is introduced and a slurry discharged. The slurry discharges from the pulping mechanism 5 through holes 24 into annular area 26 and then exits chamber 1 through a pipe connection (not shown). Further details of the pulper 10 may be found in Navy technical manual S9593-C3-MMM-010-12Y684, entitled "Pulper, Small, NAVSEA DWG. 803-6960581," 22 Jul. 1994, which is hereby incorporated by reference and is co-owned U.S. Pat. No. 5,464,161 entitled Solid Waste Pulper.

Figure 3:
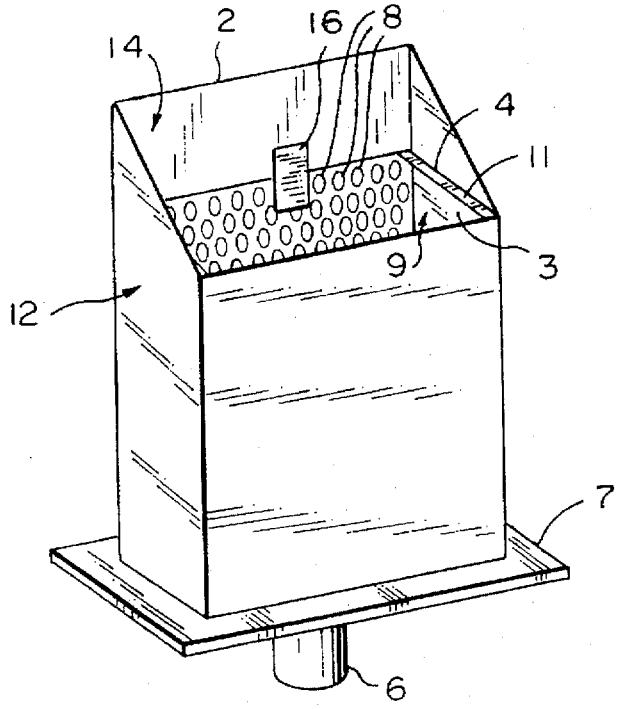
FIG. 3 is a perspective view of one aspect of the invention.

As shown in FIG. 3, the non-pulpables collection chamber 12 includes a container 2 which may be rectangular in cross-section. The container 2 has an opening 14 at a first end thereof. The container 2 may include a flanged bottom 7. A perforated or mesh junk basket 3 (also open at the top) sits inside of the container 2. The container 2 and the basket 3 may be made of metal, plastic or any other suitable material.

Figure 2:
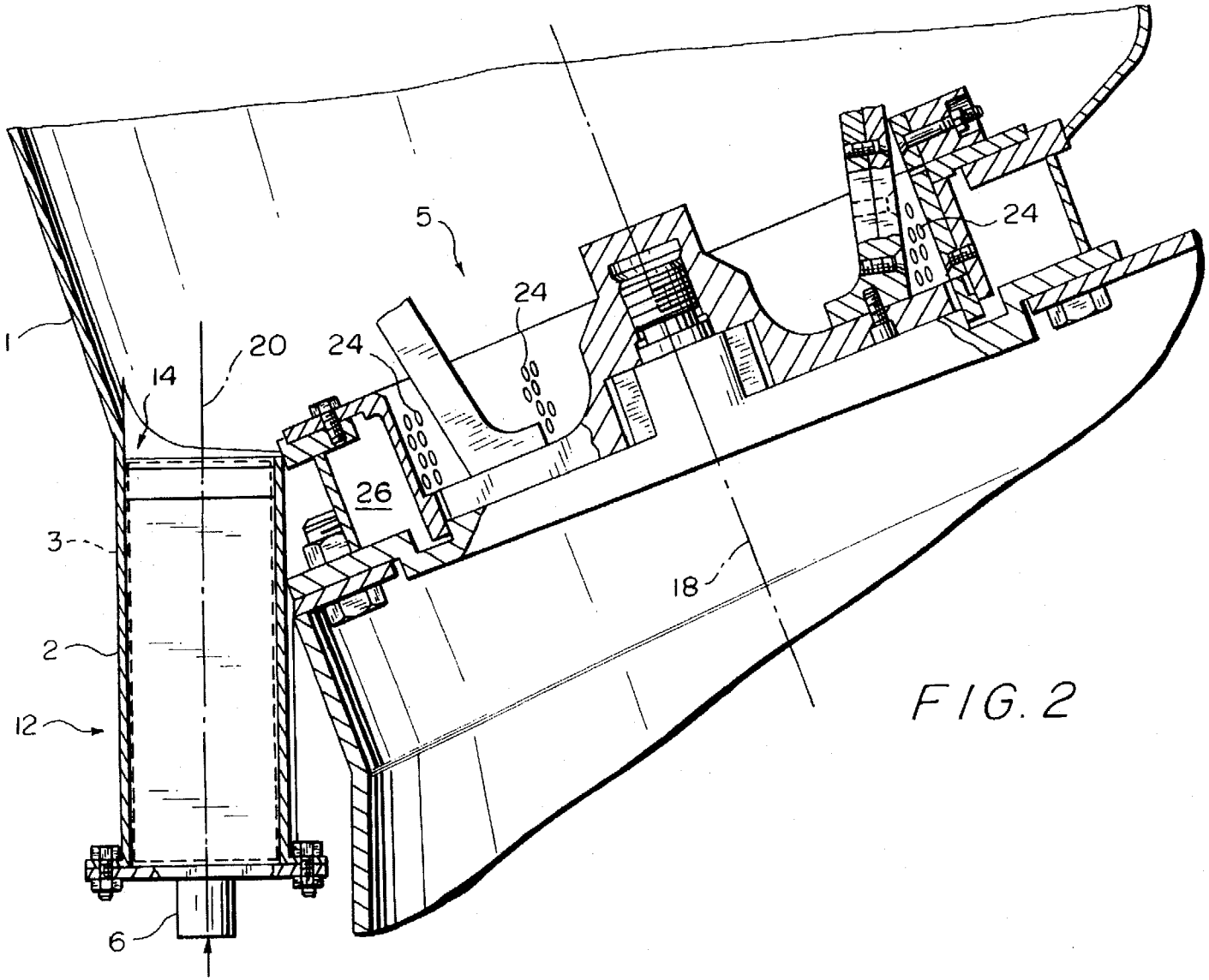
FIG. 2 is a cross-section of the invention.

As shown in FIG. 2, the collection chamber 12 is located below the pulping mechanism 5. The open end 14 is attached, for example, by welding, to the bottom of the pulping chamber 1 in the annular area outside of the pulping mechanism 5. The connection to the pulping chamber 1 forms a rectangular opening with the center of the longest sides perpendicular to the pulping mechanism's radius.

The pulping mechanism 5 has a rotation axis 18 which advantageously is tilted at an acute angle with respect to the vertical, and the collection chamber 12 has a longitudinal axis 20 that is vertically oriented. Preferably, the pulping chamber 1 and the pulping mechanism 5 are tilted at an acute angle of about 15° to 30° relative to a vertical axis, and the collection chamber 12 is oriented vertically, that is, with the openings of the collection chamber 12 and the basket 3 positioned vertically upward. The tilting facilitates (via gravity) the collection of metal and other dense, hard materials into the basket 3.

The flanged bottom 7 of the collection chamber 12 is fitted with a pipe connection 6 which provides fluid flow upward through the collection chamber at a sufficient velocity to wash out pulpable material which overflows the top of container 2 and is subsequently collected in pulper 10. The fluid may be water supplied from a source not shown. The junk basket 3 has perforations or mesh 8 on the bottom and, preferably, on at least the two widest sides. The narrow sides 9 of the basket 3 are bent at their top ends in toward the opening 11 of the basket 3 to provide a handle or means for removing the basket 3 from the collection chamber 12. The means for removing, alternatively, could be any protrusion from the basket 3 that would allow one to grasp the basket. The basket 3 is removed periodically and cleaned of solid material collected therein.

A means for restricting movement of the basket 3 in the container 2 and for preventing material from entering a space between the basket 3 and the container 2 may be, for example, an elastic gasket 4 made of rubber or plastic. The gasket 4 is attached to the container 2 just above the basket 3 to prevent the basket 3 from rattling around and to keep non-pulpables from falling in between the basket 3 and the container 2. Alternatively or additionally, the means for restricting and for preventing can be the use of a basket 3 sized to fit snugly in the container 2 and optionally held in place with a spring clip 16 between the basket 3 and the container 2 (see FIG. 3).

It is not necessary that the collection chamber 12 have a rectangular shape. The shape of the collection chamber 12 could also be, for example, square, cylindrical or ellipsoidal. Alternatively, the two longest sides of the chamber could be arcs having a center which is the center of the pulping chamber's mechanism and the two short sides could be flat. In each case, the junk basket 3 would be shaped similarly.

While the invention has been described with reference to certain embodiments, numerous alterations, changes and modifications to the described embodiments are possible without departing from the spirit and scope of the invention, as defined in the appended claims and equivalents thereof.

What is claimed is:

1. A collection chamber for a pulper of the type having a pulping chamber containing a pulping mechanism for processing pulpable material into a pulp, said collection chamber being for collecting non-pulpable material in an area outside of the pulping chamber so as not to interfere with circulation around the pulping mechanism, said collection chamber comprising:

a container having openings at first and second ends;

a basket disposed inside said container and having an opening at a first end for permitting non-pulpable material to pass downward from the pulper into said basket via said opening in said first end of said container, said basket including perforations in at least a bottom portion of said basket, said bottom portion positioned proximate said second end of said container;

a pipe connection located at said second end of said container for permitting a fluid to flow upward into said container and via said perforations into said basket to prevent pulp from settling into said collection chamber;

means for removing said basket from said container; and means for preventing material from entering a space between said basket and said container.

2. The chamber of claim 1, further comprising means for restricting the movement of said basket in said container wherein a cross-section of said container from said second end to at least a location of said means for restricting is constant.

3. The chamber of claim 2, wherein said cross-section of said container is rectangular.

4. The chamber of claim 2, wherein said means for restricting movement includes a spring clip.

5. The chamber of claim 2, further including flow means connected to said pipe connection for causing said fluid to flow upward at a constant velocity into said container and via said perforations into said basket to prevent pulp from settling into said collection chamber, said constant velocity being greater than a settling velocity of the pulp.

6. The chamber of claim 1, wherein a cross-section of said basket is rectangular.

7. The chamber of claim 6, wherein two wider sides of said basket include perforations.

8. The chamber of claim 6, wherein said means for removing includes a portion of two narrow sides of said basket at said opening of said basket, which sides are bent in toward said basket opening.

9. The chamber of claim 6, wherein said basket is sized to fit snugly within said container.

10. The chamber of claim 1, wherein said pipe connection includes a flange attached to said container.

11. The chamber of claim 1, wherein said means for preventing includes an elastic gasket attached to an interior surface of said container adjacent said opening of said basket.

12. The chamber of claim 1, further including means for fixing said container to the pulper below the pulping chamber.

13. The chamber of claim 1, wherein said chamber has a longitudinal axis that is vertically oriented and wherein said openings in said first ends of said chamber and said basket are positioned vertically upward.

* * * * *